US006857467B2

(12) United States Patent
Lach

(10) Patent No.: US 6,857,467 B2
(45) Date of Patent: Feb. 22, 2005

(54) HEAT EXCHANGE SYSTEM AND METHOD

(75) Inventor: Raymond Lach, St. Donat (CA)

(73) Assignee: Gestion Lach Inc., Montreal (CA)

( * ) Notice: Subject to any disclaimer, the term of this patent is extended or adjusted under 35 U.S.C. 154(b) by 0 days.

(21) Appl. No.: 10/361,999

(22) Filed: Feb. 7, 2003

(65) Prior Publication Data

US 2004/0154786 A1 Aug. 12, 2004

(51) Int. Cl.[7] ..... F28B 1/00
(52) U.S. Cl. ..... 165/110; 165/159; 62/238.3
(58) Field of Search ..... 62/643, 906, 335, 62/113, 238.3, 497, 476; 165/159, 108, 302, 166; 60/320

(56) References Cited

U.S. PATENT DOCUMENTS

| | | | | |
|---|---|---|---|---|
| 2,740,803 A | * | 4/1956 | Dorschner | 518/712 |
| 3,590,912 A | | 7/1971 | Elder et al. | |
| 3,779,306 A | | 12/1973 | Wilson | |
| 3,807,963 A | * | 4/1974 | Smith | 422/197 |
| 3,828,567 A | | 8/1974 | Lesczynski | |
| 4,403,650 A | * | 9/1983 | Klaren | 165/104.16 |
| 4,899,545 A | | 2/1990 | Kalina | |
| 4,919,541 A | * | 4/1990 | Grosz-Roell et al. | 366/136 |
| 5,293,842 A | | 3/1994 | Loesel | |
| 6,115,542 A | * | 9/2000 | Nir | 392/449 |
| 6,276,150 B1 | | 8/2001 | Nelson | |

FOREIGN PATENT DOCUMENTS

EP 1 136 780 A2 9/2001

OTHER PUBLICATIONS

La Vapeur, Mode d'emploi, editions PYC livres, janvier 2000.

Controling Steam Heaters, Hydrocarbon Processing, Walter Driedger Novembre 1996.

Steam Control and Condensate Drainage for Heat Exchangers. Steam Team. 1998.

Schema D'Utilisation D'Un Exchangeur Vertical au 1000 de la Gauchetière. Par Kelvin experts–conseils, janvier 1996.

* cited by examiner

*Primary Examiner*—Terrell Mckinnon
(74) *Attorney, Agent, or Firm*—LouisMartineau

(57) ABSTRACT

The heat exchange system is used for heating a first fluid with a second fluid, and includes a first fluid circuit comprising an upstream end, a downstream end and an intermediate portion therebetween and a second fluid circuit comprising an upstream end, a downstream end and an intermediate portion therebetween. The heat exchange system also includes a flooded heat exchanger unit wherein the intermediate portions of the first and second fluid circuits extend and are in adjacent, thermally-conductive contact for allowing heat transfer from the second fluid to the first fluid. The flooded heat exchanger is capable of being flooded in a determined proportion within the second fluid circuit intermediate portion. The heat exchange system further includes a second fluid circuit control valve located at the second fluid circuit downstream end, for controlling the flow rate of the second fluid through the second fluid circuit, whereby the proportion of the heat exchanger which is flooded within the second fluid circuit intermediate portion can be selectively calibrated. The heat exchange system also includes a first fluid pre-heating device located between the first fluid circuit upstream end and the heat exchanger unit, for partly pre-heating the first fluid before it is heated by the second fluid, whereby the first fluid temperature at the first fluid circuit downstream end will be stabilized.

13 Claims, 2 Drawing Sheets

HEAT EXCHANGE SYSTEM AND METHOD

FIELD OF THE INVENTION

The present invention relates to heat exchange systems, and more particularly to a heat exchange system and method by which a first fluid is heated by a second fluid.

BACKGROUND OF THE INVENTION

Known heat exchange systems can be used for different purposes, such as for heating water used for domestic, commercial or industrial purposes. For example, a hotel or the like establishment is required to make hot water available upon demand by its clients, such as for warm showers. At certain times during the day, almost no hot water demand occurs, while at certain other times during the day, very high hot water consumption occurs. Also, the main hotel heating system may be of the water-heating type, wherein hot water is circulated in thermally-conductive pipes that run throughout the hotel rooms.

Conventional heat exchange systems used to heat the water, for example used either by the hotel clients or for the hotel heating system, comprise two fluid circuits. Water to be heated circulates in the first fluid circuit in a liquid state. Water vapor circulates in the second fluid circuit at high temperatures (well over 212° F. or 100° C.). Both fluid circuits pass through a heat exchanger unit wherein the water to be heated will flow in pipes running through the heat exchanger unit, and wherein the hot water vapor will flow on the shell side of the heat exchanger through heat exchanger baffles around the pipes, transferring the heat through the thermally conductive pipes (and baffle plates) to the water to be heated. The water consequently exits the heat exchanger unit in a heated state. If the demand for hot water increases, the flow rate of the hot water vapor can be increased, and vice-versa.

Two main problems are related to these prior art systems. The first problem is that the efficiency of the heat exchange system is low, energy-wise. The second problem is that the temperature of the heated water at the outlet will vary according to outgoing water flow rate variations and/or according to incoming water temperature variations. This is especially true at low working-load of heat exchange systems (the low working-load of a heat exchange system is usually defined as 40% or less of its capacity, and the high working-load is usually defined as more than 40% of its capacity). Indeed, since the water flow rate through the heat exchanger unit may vary according to the demand, and/or since the temperature of the incoming water may also vary, the quantity of energy transmitted to the heated water cannot be precisely calibrated, and consequently the outlet temperature of the heated water cannot be regulated very precisely. The very high temperature of the hot water vapor (well over 212° F. or 100° C.), although necessary to rapidly heat the water in high working-load operation of the heat exchange system, also promotes this lack of precision in heating the water, since the very hot water vapor will often be too hot for a low working-load operation of the heat exchange system wherein a low quantity of energy is required. The disadvantageous consequence of this problem is that the outlet water transmitted will have a temperature which will vary relative to the desired water temperature. It is not uncommon to see water temperatures vary of 20° F. (11.1° C.) and more relative to the desired water temperature in conventional heat exchange systems.

SUMMARY OF THE INVENTION

The present invention relates to a heat exchange system for heating a first fluid by means of a second fluid, comprising:

a first fluid circuit comprising an upstream end, a downstream end and an intermediate portion therebetween, said first fluid circuit being destined to allow the first fluid to flow from said first fluid circuit upstream end to said first fluid circuit downstream end;

a second fluid circuit comprising an upstream end, a downstream end and an intermediate portion therebetween, said second fluid circuit being destined to allow the second fluid to flow from said second fluid circuit upstream end to said second fluid circuit downstream end;

a flooded heat exchanger unit wherein said intermediate portions of said first and second fluid circuits extend and are in adjacent, thermally-conductive contact for allowing heat transfer from the second fluid to the first fluid, said flooded heat exchanger being capable of being flooded in a determined proportion within said second fluid circuit intermediate portion;

a second fluid circuit control valve on said second fluid circuit downstream of said heat exchanger unit, for controlling the flow rate of the second fluid through said second fluid circuit, wherein the proportion of said heat exchanger which is flooded within said second fluid circuit intermediate portion can be selectively calibrated; and a stabilization circuit having a re-circulation inlet linked to said first fluid circuit between said heat exchanger unit and said first fluid circuit downstream end, and a re-circulation outlet linked to said first fluid circuit between said first fluid circuit upstream end and said heat exchanger unit, for allowing a determined proportion of heated first fluid exiting said heat exchanger to be re-circulated from said re-circulation inlet to said re-circulation outlet where it is admixed with first fluid flowing from said first fluid circuit upstream end whereby the first fluid temperature at said first fluid circuit downstream end will be stabilized.

In one embodiment, said flooded heat exchanger unit is a vertical flooded heat exchanger unit comprising a number of tubes fluidingly connecting said heat exchanger second fluid inlet and outlet and forming said second fluid circuit intermediate portion, with said first fluid circuit intermediate portion extending around said tubes on a shell side of said heat exchanger.

In one embodiment, said stabilization circuit comprises a pump for pumping said first fluid from said re-circulation inlet to said re-circulation outlet.

In one embodiment, said pump has a variable flow rate.

In one embodiment, said heat exchange system further comprises a steam trap located on said second fluid circuit downstream of said second fluid control valve.

In one embodiment, said steam trap has a steam lock release option for allowing gazeous-state second fluid to be evacuated from said second fluid circuit.

In one embodiment, said heat exchange system further comprises a bleed valve on said second fluid circuit between said second fluid control valve and said steam strap, for evacuating gazeous-state fluids from said second fluid circuit.

In one embodiment, said heat exchange system further comprises a liquid-state second fluid evacuation circuit having a liquid-state second fluid evacuation inlet located between said second fluid circuit upstream end and said heat exchanger second fluid inlet, and a liquid-state second fluid evacuation outlet located between said heat exchanger second fluid outlet and said second fluid circuit downstream end, for allowing liquid-state second fluid to be evacuated therethrough.

In one embodiment, said liquid-state second fluid evacuation outlet comprises a mixer for mixing the liquid-state second fluid flowing through said liquid-state second fluid evacuation circuit and the liquid state second fluid flowing from said heat exchanger second fluid outlet.

In one embodiment, said first and second fluid circuits allow for co-current first and second fluid flow within said heat exchanger unit.

The present invention also relates to a heat exchange system for heating a first fluid by means of a second fluid, comprising:

a first fluid circuit comprising an upstream end, a downstream end and an intermediate portion therebetween, said first fluid circuit being destined to allow the first fluid to flow from said first fluid circuit upstream end to said first fluid circuit downstream end;

a second fluid circuit comprising an upstream end, a downstream end and an intermediate portion therebetween, said second fluid circuit being destined to allow the second fluid to flow from said second fluid circuit upstream end to said second fluid circuit downstream end;

a flooded heat exchanger unit wherein said intermediate portions of said first and second fluid circuits extend and are in adjacent, thermally-conductive contact for allowing heat transfer from the second fluid to the first fluid, said flooded heat exchanger being capable of being flooded in a determined proportion within said second fluid circuit intermediate portion;

a second fluid circuit control valve on said second fluid circuit downstream of said heat exchanger unit, for controlling the flow rate of the second fluid through said second fluid circuit, wherein the proportion of said heat exchanger which is flooded within said second fluid circuit intermediate portion can be selectively calibrated; and first fluid pre-heating means located between said first fluid circuit upstream end and said heat exchanger unit, for partly pre-heating said first fluid before it is heated by said second fluid, whereby the first fluid temperature at said first fluid circuit downstream end will be stabilized.

The present invention further relates to a method of heating a first fluid with a second fluid within a heat exchange system, said method comprising the steps of:

circulating said first fluid through a first fluid circuit comprising an upstream end, a downstream end and an intermediate portion therebetween;

circulating said second fluid through a second fluid circuit comprising an upstream end, a downstream end and an intermediate portion therebetween, with said second fluid being in a gazeous state at said second fluid circuit upstream end;

providing a flooded heat exchanger unit wherein said intermediate portions of said first and second fluid circuits are in adjacent, thermally-conductive contact whereby heat from the second fluid is transferred to the first fluid;

condensing said second fluid inside a portion of said second fluid circuit intermediate portion, wherein a condensed second fluid column occupying from 0% to 100% of the length of said second fluid circuit intermediate portion is created;

selectively adjusting, with a control valve located between said heat exchanger unit and said second fluid circuit downstream end, the heat exchange capacity of said heat exchanger unit by calibrating the proportion of said second fluid circuit intermediate portion occupied by said condensed second fluid column; and pre-heating at least a portion of said first fluid before it enters said first fluid circuit intermediate portion.

In one embodiment, said pre-heating of at least a portion of said first fluid before it enters said first fluid intermediate portion, is accomplished according to the following step:

re-circulating a selected proportion of heated first fluid within said heat exchanger by providing a stabilization circuit having a re-circulation inlet linked to said first fluid circuit between said heat exchanger unit and said first fluid circuit downstream end, and a re-circulation outlet linked to said first fluid circuit between said first fluid circuit upstream end and said heat exchanger unit, for allowing a determined proportion of heated first fluid exiting said heat exchanger to be re-circulated from said re-circulation inlet to said re-circulation outlet where it is admixed with first fluid flowing from said first fluid circuit upstream end whereby the first fluid temperature at said first fluid circuit downstream end will be stabilized.

DETAILED DESCRIPTION OF THE EMBODIMENTS

Figure 1:
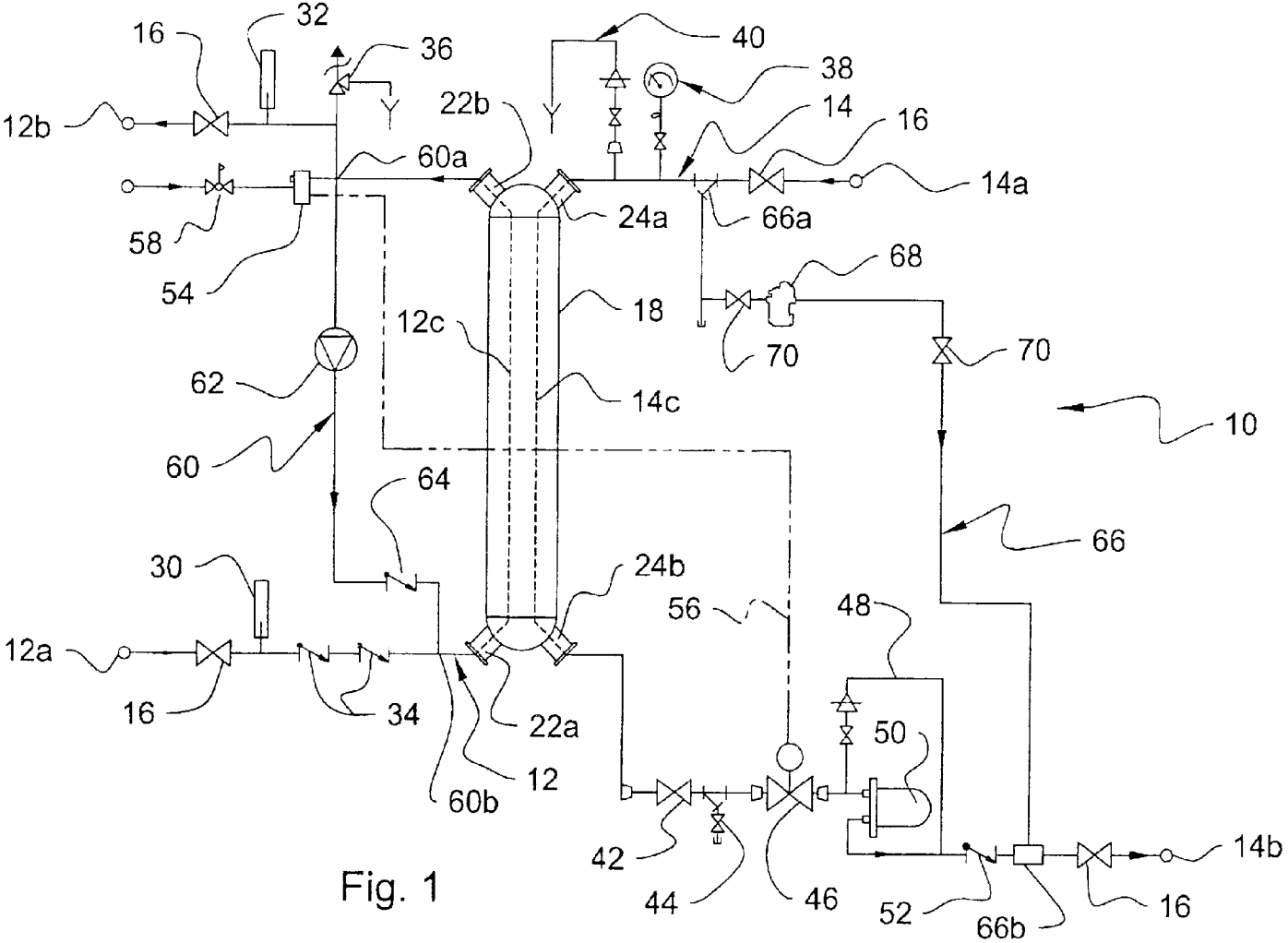
FIG. 1 is a schematic view of the heat exchange system fluid circuit according to the present invention.

FIG. 1 shows the fluid circuit of the heat exchange system 10 according to the present invention. Heat exchange circuit 10 is destined to be used to heat a first colder fluid with a second hotter fluid.

Heat exchange circuit 10 comprises a first linear fluid circuit 12 made of pipes or the like fluid-tight carrying medium of known construction. First fluid circuit 12 comprises an upstream end 12*a*, a downstream end 12*b* and an intermediate portion 12*c* therebetween. First fluid circuit 12 allows the first fluid to flow from first fluid circuit upstream end 12*a* to first fluid circuit downstream end 12*b*.

Heat exchange circuit 10 also comprises a second fluid circuit 14 also made of pipes or the like fluid-tight carrying medium of known construction. Second fluid circuit 14 comprises an upstream end 14*a*, a downstream end 14*b* and an intermediate portion 14*c* therebetween. Second fluid circuit 14 allows the second fluid to flow from second fluid circuit upstream end 14*a* to second fluid circuit downstream end 14*b*.

Isolation valves 16 are provided near the first and second fluid circuit upstream and downstream ends 12*a*, 12*b*, 14*a*, 14*b*. Isolation valves 16 are normally always opened to allow fluid flow therethrough, and can be selectively closed, for example for maintenance purposes.

Figure 2:
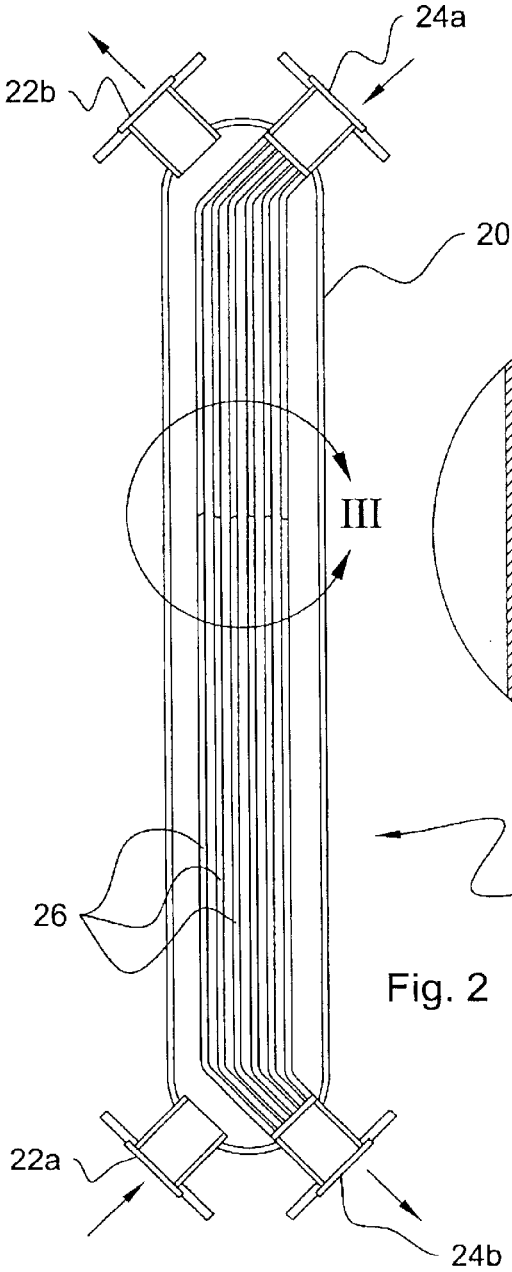
FIG. 2 is a schematic cross-sectional view of the heat exchanger unit being part of the heat exchange system of FIG. 1.

Heat exchange circuit 10 further comprises a heat exchanger unit 18 wherein the intermediate portions 12*c*, 14*c* of the first and second fluid circuits 12, 14 are in adjacent, thermally-conductive contact for allowing heat transfer from the second fluid to the first fluid. FIG. 2 shows that heat exchanger unit 18 comprises a casing 20 having a first fluid inlet 22*a*, a first fluid outlet 22*b*, a second fluid inlet 24*a* and a second fluid outlet 24*b*. Tubes 26 link the second fluid inlet and outlet 24*a* and 24*b*, while first fluid inlet and outlet 22*a* and 22*b* are linked on the shell side of heat exchanger unit 18, although both fluid intermediate portions are schematically shown in dotted lines within heat exchanger unit 18 in FIG. 1.

Although tubes 26 are shown to have a generally straight configuration in FIG. 2, it is understood that tubes 26 could (and usually will) have a sinuous, curved, often corrugated configuration by which an increased heat exchange surface is provided for each tube 26. Baffle plates (not shown) can also be provided in casing 20 along the first fluid circuit line or shell side, which increases the turbulence within the first fluid, the time the first fluid spends in the heat exchanger unit 18 and consequently the time that the first fluid is in contact with tubes 26. Accordingly, it is understood that any suitable inner heat exchanger unit configuration could be provided other than the schematic configuration shown in FIG. 2.

Figure 3:
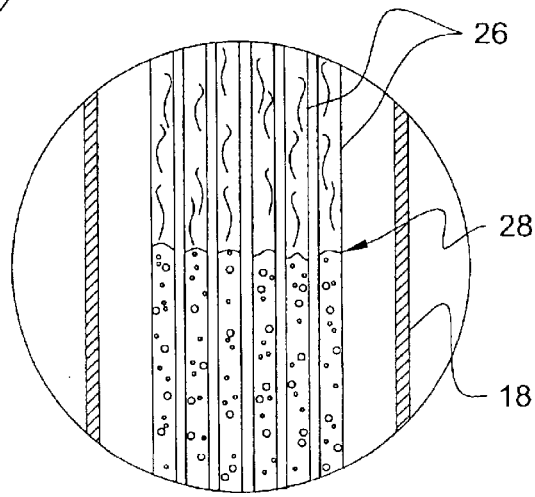
FIG. 3 is an enlarged view of the area circumscribed by circular line III in FIG. 2.

According to the present invention, heat exchanger unit 18 is a flooded heat exchanger which is designed for allowing the second fluid, initially in a gaseous state at the second fluid inlet 24*a*, to condense inside tubes 26. The condensation of the second fluid can be obtained by providing the proper diametrical size and length to tubes 26 (although alternate methods of flooding the second fluid circuit intermediate portion could be envisioned). Indeed, by having particularly long tubes 26 of relatively small diameter, the heat exchange surface of the second fluid per unit of volume is increased, which may yield second fluid condensation if the temperature difference between the colder first fluid and the hotter second fluid is important enough. A condensed second fluid column is thus formed in tubes 26. This is schematically shown in FIG. 3 where it can be seen that above a certain condensation level 28, the second fluid is in a gazeous state within tubes 26, while below condensation level 28, the second fluid is in a liquid state. Since the passing of a fluid from a gazeous state to a liquid state is highly exothermic, the heat exchange capacity, and therefore the efficiency, of heat exchanger unit 18 is increased compared to non-flooded heat exchanger units. This is especially true at full working-load of the heat exchanger, in which the heating fluid remains in the gazeous state throughout its passage within the heat exchanger unit in prior art heat exchanger systems. Also, in modulating working load of the heat exchanger unit (e.g. varying inlet temperature or flow rate of the first fluid), especially at 40% capacity or less, the flooded heat exchanger unit 18 will react by varying the water level in tubes 26, whereas prior art non-flooded heat exchangers will require a vacuum breaker at the second fluid outlet to allow ambient air to first break the vacuum inside the heat exchanger which is caused by the condensing second fluid, and then cool down the gazeous state second fluid (e.g. steam) temperature.

It is noted that so-called sub-cooling will occur in heat exchanger due to the presence of the liquid-state second fluid column, i.e. that the condensed liquid-state second fluid column will also transfer heat to the first fluid, in addition to heat transfer occurring from the gazeous-state second fluid to the first fluid.

According to a preferred embodiment, flooded heat exchanger unit 18 is a vertical flooded heat exchanger unit, wherein the condensed second fluid will automatically form a column within tubes 26 due to the fact that the liquid-state second fluid will be more dense than the gazeous-state second fluid.

FIG. 1 shows that first fluid circuit 12 comprises the following components located between first fluid circuit upstream end 12*a* and heat exchanger first fluid inlet 22*a*: an upstream fluid temperature indicator 30 capable of indicating the temperature of the first fluid at the first fluid circuit upstream end 12*a*; and a pair of serially installed check valves 34 located upstream of the heat exchanger inlet 22*a* and preventing accidental first fluid back flow. First fluid circuit 12 comprises the following components located between heat exchanger first fluid outlet 22*b* and first fluid circuit downstream end 12*b*: a downstream fluid temperature indicator 32 capable of indicating the temperature of the first fluid at the first fluid circuit downstream end 12*b*; and a temperature/pressure security valve 36 which will allow emergency egress of the second fluid in case temperature or pressure thresholds are overstepped.

Turning now to the second fluid circuit 14, it comprises the following components located between second fluid circuit upstream end 14*a* and heat exchanger second fluid inlet 24*a*: an upstream manometer 38 to indicate the gazeous second fluid pressure near the second fluid circuit upstream end 14*a*; and an air eliminator 40 near the second fluid circuit upstream end 14*a* to eliminate the air from the second fluid circuit when the heat exchange system 10 is initialized from an empty state wherein second fluid circuit 14 is empty of second fluid. Air eleminator 40 also acts to remove non-condensable fluids (such as air) from second fluid circuit 14 during normal operation. Second fluid circuit 14 comprises the following components between heat exchanger second fluid outlet 24*b* and second fluid circuit downstream end 14*b*: an isolation valve 42 being normally in an opened condition to allow fluid flow therethrough; a strainer with screen 44 to prevent sediments from reaching a control valve 46, whose purpose will be detailed hereinafter; an automatic bleed valve 48 downstream of control valve 46 to remove gazeous fluid from the second fluid circuit between control valve 46 and a steam trap 50 located downstream thereof, steam trap 50 being of known construction and preventing gazeous-state second fluid from flowing therethrough in case of failure of control valve 46 which could remain stuck in an opened position; and a check valve 52 preventing fluid back flow.

Automatic bleed valve 48 is advantageously positioned immediately upstream of steam trap 50, since the latter may cause pressure to rise in some circumstances, and consequently the second fluid may occasionally undesirably vaporize into a gazeous state between control valve 46 and steam trap 50. Furthermore, steam trap 50 includes, according to one embodiment, a steam lock release option which allows not only the non condensable gases to be evacuated through steam trap 50 as is known in the art, but furthermore to allow also condensable gases such as gazeous state second fluid to be evacuated therethrough, thereby further helping to desirably prevent gazeous state second fluid presence within second fluid circuit 14 downstream of control valve 46. Indeed, gazeous-state second fluid in second fluid circuit 14 downstream of control valve 46 is likely to cause so-called water hammers, which result from the sudden passage of the second fluid from gazeous state to liquid state and which cause "implosions" due to the vacuum suddenly caused by this change of state. Furthermore, any presence of gazeous-state fluid in second fluid circuit downstream of control valve 46 may prematurely force steam trap 50 to close and again cause water hammer problems.

Control valve 46 can allow a variable flow rate of second fluid therethrough. A controller device 54 is linked to and controls control valve 46. Controller device 54 can be any type of known controller (pneumatic or electronic), for example a pneumatic controller device 54 which operates on control valve 46 by means of an air flow through a pneumatic circuit 56. An air regulator 58 controls the air pressure required at controller device 54. Controller device 54 includes a manually operable control means (not shown) which allows a selective adjustment of the control valve 46 opening. If control valve 46 is controlled to increase the second fluid flow rate within second fluid circuit 14, then the height of the liquid-state second fluid column within tubes 26 will decrease, consequently increasing the proportion of tubes 26 which are occupied by hotter, gazeous-state second fluid, therefore increasing the heat exchange rate within heat exchanger unit 18. However, if control valve 46 is controlled to decrease the second fluid flow rate within the second fluid circuit, then the height of the liquid-state second fluid column within tubes 26 will increase, consequently decreasing the proportion of tubes 26 which are occupied by hotter, gazeous-state second fluid, therefore decreasing the heat exchange rate within heat exchanger unit 18.

In addition to the manual control means provided on controller device 54, controller device 54 is operatively connected to first fluid circuit 12 near first fluid circuit downstream end 12*b*. Thus, controller device 54 can calibrate the opening of control valve 46 according to the first fluid temperature that it detects at first fluid circuit downstream end 12*b*. If the actual temperature of the first fluid is colder than the required temperature which has been manually programmed on controller device 54, then controller device 54 will open control valve 46 to decrease the condensed second fluid column in second fluid circuit, thus increasing the heat exchange capacity between the first and second fluids, and vice versa.

Anywhere from 0% to 100% of tubes 26 within heat exchanger unit 18 can thus be filled with gazeous-state second fluid, and inversely from 100% to 0% of tubes 26 will be filled with liquid-state second fluid. This allows for an increased control over the heat exchange within heat exchanger unit 18. Indeed, in the case where the first fluid to be heated is only slightly under the desired temperature or in the case where only a small flow rate of first fluid flows through first fluid circuit 12, the opening of control valve 46 will be only slightly increased, thus providing for a very small additional percentage of tubes 26 to be filled with hotter, gazeous-state second fluid. This will only slightly increase the heat exchange to the first fluid, which is less likely to become too hot. However, should the first fluid be much colder than the desired temperature or should the first fluid have an important flow rate through first fluid circuit 12, then a more important proportion of tubes 26 will be filled with hotter gazeous-state second fluid through a corresponding control of the opening of valve 46, and consequently the heat exchange will be desirably more important.

This calibrated control of the level of flooding within tubes 26 is especially advantageous at low working-load of heat exchange system 10. Indeed, in such a situation, where conventional heat exchanger units are likely to overheat the first fluid due to the use of hotter gazeous-state second fluid throughout the second fluid circuit intermediate portion, the flooded heat exchanger unit 18 of the present invention can allow gazeous-state second fluid in only a small proportion of tubes 26, which permits a smaller, more gradual heat exchange between the first and second fluid, thus preventing first fluid overheating.

A stabilization circuit 60 is installed to form a loop within a portion of first fluid circuit 12. More particularly, stabilization circuit 60 defines a re-circulation inlet 60*a* which is fluidingly connected to first fluid circuit 12 between heat exchanger first fluid outlet 22*b* and first fluid circuit downstream end 12*b*, and a re-circulation outlet 60*b* which is fluidingly connected to first fluid circuit 12 between first fluid circuit upstream end 12*a* and heat exchanger first fluid inlet 22*a*. Stabilization circuit 60 allows a determined proportion of heated first fluid from being re-circulated through the first fluid circuit intermediate portion 12*c*, admixed with a quantity of colder first fluid flowing from the first fluid circuit upstream end 12*a*.

Stabilization circuit 60 more particularly includes, in addition to the required pipes, a re-circulation pump 62 to pump a determined quantity of fluid from re-circulation inlet 60*a* to re-circulation outlet 60*b*. A check valve 64 is provided to prevent accidental fluid back flow towards re-circulation inlet 60*a* through stabilization circuit 60.

The purpose of stabilization circuit 60 is to stabilize the first fluid temperature at the first fluid outlet 22*b* when inlet temperature or flow rate variations occur. This is accomplished by increasing the first fluid temperature at first fluid inlet 22*a*, before the actual heat exchange occurs between the first and second fluids. Indeed, by having a fluid which is partly pre-heated by admixing hotter fluid with the colder fluid originating from the first fluid circuit upstream end 12*a*, the temperature of the first fluid flowing into heat exchanger unit 18 is increased. Since higher temperature gradients require more gazeous-state second fluid in tubes 26, and since more gazeous-state second fluid in tubes 26 means that it is more likely that the first fluid will eventually be overheated, having a hotter first fluid at the heat exchanger first fluid inlet increases the likelihood that the first fluid temperature will be more stable at the heat exchanger first fluid outlet 22*b*.

This last feature, in combination with the use of a flooded heat exchanger unit wherein the second fluid flow through second fluid circuit 14 is controlled by means of a control valve 46 located downstream of heat exchanger second fluid outlet 24*b* to selectively calibrate the height of the condensed second fluid column in tubes 26, has provided highly unexpected and advantageous results in obtaining an energetically efficient heat exchange system, wherein the first fluid is heated at a temperature which is very stable relative to the desired temperature, or in other words wherein the first fluid temperature at the heat exchanger first fluid outlet 22*b* has little variations relative to desired first fluid temperature, even under low working-load operation of heat exchange system 10. For example, heat exchange systems 10 built according to the teachings of the present invention have provided for temperature variations which remain within 2° F. (or 1.11° C.) of the desired temperature.

According to a first embodiment, re-circulation pump 62 has a constant flow rate. According to an alternate embodiment, re-circulation pump 62 has a variable flow rate, wherein the flow rate of first fluid re-circulated through stabilization circuit 60 to be admixed to the incoming colder first fluid, will be proportional to the hot first fluid demand.

A liquid-state second fluid evacuation circuit 66 is installed within second fluid circuit 14. More particularly, liquid-state second fluid evacuation circuit 66 has a liquid-state second fluid evacuation inlet 66*a* which is fluidingly connected to second fluid circuit 14 downstream of second fluid circuit downstream end 14*a* and upstream of heat exchanger second fluid inlet 24*a*, and a liquid-state second fluid evacuation outlet 66*b* which is fluidingly connected to second fluid circuit 14 dowstream of steam trap 50 and upstream of second fluid circuit downstream end 14*b*.

Liquid-state second fluid evacuation inlet 66*a* comprises a screen. Liquid-state second fluid evacuation outlet 66*b* comprises a mixer. According to one embodiment, mixer 66*b* helps both liquid-state second fluid streams which are at different temperatures, namely the colder liquid coming from the heat exchanger unit 18 and the hotter liquid coming from liquid-state second fluid evacuation circuit 66, to be mixed without undesirable water hammers within heat exchange system circuit 10.

An automatic liquid-state bleed device 68 installed on water evacuation circuit 66 allows liquid-state fluid only to be re-directed towards the mixer at liquid-state second fluid evacuation outlet 66*b*. There, this liquid-state second fluid will be mixed with the colder liquid-state second fluid that flows through tubes 26, and the resulting liquid-state second fluid will be conveyed towards second fluid circuit downstream end 14*b*, from where it will be conveyed to a suitable location.

It is noted that in practice, some liquid-state second fluid re-vaporization will in fact occur downstream of automatic liquid-state bleed device 68.

Isolation valves 70, 70 are installed on either side of bleed device 68.

According to the embodiment shown in FIGS. 1 and 2, the first and second fluid inlets 22*a*, 24*a* are provided at opposite extremities of heat exchanger unit, as are the first and second fluid outlets 22*b*, 24*b*, to allow first and second fluid counter-current flow within heat exchanger 18. It is understood, however, that first and second fluid co-current flow could also be used, wherein the first fluid inlet would be adjacent the second fluid inlet at a first extremity of the heat exchanger unit, and the first fluid outlet would be adjacent the second fluid outlet at a second extremity of the heat exchanger unit.

According to one embodiment of the invention, the stabilization circuit 60 could be replaced with any suitable first fluid pre-heating means by which the first fluid would be partly heated before it enters the heat exchanger unit. Any suitable device or mechanism to accomplish this, as would be obvious to someone skilled in the art, would be acceptable, such as heating electrical resistances, and the like. However, the first fluid stabilization circuit provides a few important advantages which make it a preferable way to carry out the invention: (1) it is energetically efficient, since only a low electrically consuming pump is required; (2) the first fluid will not be overheated in any circumstance, since the re-circulated first fluid will at most have the temperature required at first fluid circuit downstream end 12*b*.

According to one embodiment of the invention, the first fluid circulated in heat exchange system 10 is water which remains in liquid state throughout first fluid circuit 12, and the second fluid is also water, being in vapor state at the second fluid circuit upstream end 14*a*, and being in a condensed, liquid state under its condensation level 28. The particular use of a heat exchange system for heating water with water vapor is quite frequent, which allows for a retro-fit installation of the heat exchange system 10 to replace prior art heat exchange systems on existing water circuitry.

Another advantage of the heat exchange system 10 of the present invention relies on the fact that due to the fact that the second fluid flow rate control valve 46 is provided downstream of the heat exchanger second fluid outlet, the second fluid pressure remains at a high level in the second fluid circuit 14, which allows the second fluid circuit to operate without any additional pump being required near the second fluid circuit downstream end. Also, due to the use of a flooded heat exchanger, the pressure and temperature of the incoming gazeous-state second fluid do not have to be reduced in low working-load of the heat exchanger unit 18 to prevent overheating of the first fluid.

The heat exchange system of the present invention including a flooded heat exchanger allows for significant energy savings compared to conventional heat exchangers. Indeed, energy savings of up to 20% or more have been accomplished compared to conventional prior art heat exchange systems.

I claim:

1. A heat exchange system for heating a first fluid by means of a second fluid, comprising:

a first fluid circuit comprising an upstream end, a downstream end and an intermediate portion therebetween, said first fluid circuit being destined to allow the first fluid to flow from said first fluid circuit upstream end to said first fluid circuit downstream end;

a second fluid circuit comprising an upstream end, a downstream end and an intermediate portion therebetween, said second fluid circuit being destined to allow the second fluid to flow from said second fluid circuit upstream end to said second fluid circuit downstream end;

a flooded heat exchanger unit wherein said intermediate portions of said first and second fluid circuits extend and are in adjacent, thermally-conductive contact for allowing heat transfer from the second fluid to the first fluid, said flooded heat exchanger being capable of being flooded in a determined proportion within said second fluid circuit intermediate portion;

a second fluid circuit control valve on said second fluid circuit downstream of said heat exchanger unit, for controlling the flow rate of the second fluid through said second fluid circuit, wherein the proportion of said heat exchanger which is flooded within said second fluid circuit intermediate portion can be selectively calibrated; and a stabilization circuit having a re-circulation inlet linked to said first fluid circuit between said heat exchanger unit and said first fluid circuit downstream end, and a re-circulation outlet linked to said first fluid circuit between said first fluid circuit upstream end and said heat exchanger unit, for allowing a determined proportion of heated first fluid exiting said heat exchanger to be re-circulated from said re-circulation inlet to said re-circulation outlet where it is admixed with first fluid flowing from said first fluid circuit upstream end whereby the first fluid temperature at said first fluid circuit downstream end will be stabilized.

2. A heat exchange system as defined in claim 1, wherein said flooded heat exchanger unit is a vertical flooded heat exchanger unit comprising a number of tubes fluidingly connecting said heat exchanger second fluid inlet and outlet and forming said second fluid circuit intermediate portion, with said first fluid circuit intermediate portion extending around said tubes on a shell side of said heat exchanger.

3. A heat exchange system as defined in claim 2, wherein said stabilization circuit comprises a pump for pumping said first fluid from said re-circulation inlet to said re-circulation outlet.

4. A heat exchange system as defined in claim 3, wherein said pump has a variable flow rate.

5. A heat exchange system as defined in claim 2, further comprising a steam trap located on said second fluid circuit downstream of said second fluid control valve.

6. A heat exchange system as defined in claim 5, wherein said steam trap has a steam lock release option for allowing gazeous-state second fluid to be evacuated from said second fluid circuit.

7. A heat exchange system as defined in claim 6, further comprising a bleed valve on said second fluid circuit between said second fluid control valve and said steam strap, for evacuating gazeous-state fluids from said second fluid circuit.

8. A heat exchange system as defined in claim 2, further comprising a liquid-state second fluid evacuation circuit having a liquid-state second fluid evacuation inlet located between said second fluid circuit upstream end and said heat exchanger second fluid inlet, and a liquid-state second fluid evacuation outlet located between said heat exchanger second fluid outlet and said second fluid circuit downstream end, for allowing liquid-state second fluid to be evacuated therethrough.

9. A heat exchange system as defined in claim 8, wherein said liquid-state second fluid evacuation outlet comprises a mixer for mixing the liquid-state second fluid flowing through said liquid-state second fluid evacuation circuit and the liquid state second fluid flowing from said heat exchanger second fluid outlet.

10. A heat exchange system as defined in claim 1, wherein said first and second fluid circuits allow for co-current first and second fluid flow within said heat exchanger unit.

11. A heat exchange system for heating a first fluid by means of a second fluid, comprising:

a first fluid circuit comprising an upstream end, a downstream end and an intermediate portion therebetween, said first fluid circuit being destined to allow the first fluid to flow from said first fluid circuit upstream end to said first fluid circuit downstream end;

a second fluid circuit comprising an upstream end, a downstream end and an intermediate portion therebetween, said second fluid circuit being destined to allow the second fluid to flow from said second fluid circuit upstream end to said second fluid circuit downstream end;

a flooded heat exchanger unit wherein said intermediate portions of said first and second fluid circuits extend and are in adjacent, thermally-conductive contact for allowing heat transfer from the second fluid to the first fluid, said flooded heat exchanger being capable of being flooded in a determined proportion within said second fluid circuit intermediate portion;

a second fluid circuit control valve on said second fluid circuit downstream of said heat exchanger unit, for controlling the flow rate of the second fluid through said second fluid circuit, wherein the proportion of said heat exchanger which is flooded within said second fluid circuit intermediate portion can be selectively calibrated; and first fluid pre-heating means located between said first fluid circuit upstream end and said heat exchanger unit, for partly pre-heating said first fluid before it is heated by said second fluid, whereby the first fluid temperature at said first fluid circuit downstream end will be stabilized.

12. A method of heating a first fluid with a second fluid within a heat exchange system, said method comprising the steps of:

circulating said first fluid through a first fluid circuit comprising an upstream end, a downstream end and an intermediate portion therebetween;

circulating said second fluid through a second fluid circuit comprising an upstream end, a downstream end and an intermediate portion therebetween, with said second fluid being in a gazeous state at said second fluid circuit upstream end;

providing a flooded heat exchanger unit wherein said intermediate portions of said first and second fluid circuits are in adjacent, thermally-conductive contact whereby heat from the second fluid is transferred to the first fluid;

condensing said second fluid inside a portion of said second fluid circuit intermediate portion, wherein a condensed second fluid column occupying from 0% to 100% of the length of said second fluid circuit intermediate portion is created;

selectively adjusting, with a control valve located between said heat exchanger unit and said second fluid circuit downstream end, the heat exchange capacity of said heat exchanger unit by calibrating the proportion of said second fluid circuit intermediate portion occupied by said condensed second fluid column; and pre-heating at least a portion of said first fluid before it enters said first fluid circuit intermediate portion.

13. A method as defined in claim 12, wherein said pre-heating of at least a portion of said first fluid before it enters said first fluid intermediate portion, is accomplished according to the following step:

re-circulating a selected proportion of heated first fluid within said heat exchanger by providing a stabilization circuit having a re-circulation inlet linked to said first fluid circuit between said heat exchanger unit and said first fluid circuit downstream end, and a re-circulation outlet linked to said first fluid circuit between said first fluid circuit upstream end and said heat exchanger unit, for allowing a determined proportion of heated first fluid exiting said heat exchanger to be re-circulated from said re-circulation inlet to said re-circulation outlet where it is admixed with first fluid flowing from said first fluid circuit upstream end whereby the first fluid temperature at said first fluid circuit downstream end will be stabilized.

* * * * *